US005832858A

United States Patent [19]

Ortlepp et al.

[11] Patent Number: 5,832,858

[45] Date of Patent: Nov. 10, 1998

[54] MARINE MINESWEEPING VESSEL

[76] Inventors: Peter Ortlepp, Christiansweg 24, 24536 Neumunster, Germany; Horst Becher, Suderstrasse 4, 24214 Gettorf, Germany; Ulrich Stauble, Heidbergredder 65, 24147 Klausdorf, Germany

[21] Appl. No.: 413,685

[22] Filed: Mar. 30, 1995

[30] Foreign Application Priority Data

Mar. 31, 1994 [DE] Germany ..... 44 11 299.7

[51] Int. Cl.[6] ..... B63B 9/00

[52] U.S. Cl. ..... 114/221 R

[58] Field of Search ..... 114/221 A, 221 R, 114/240 R, 245, 240 A; 102/402; 89/1.13; 342/13

[56] References Cited

U.S. PATENT DOCUMENTS

| | | | |
|---|---|---|---|
| 3,938,459 | 2/1976 | Wilbanks et al. . | |
| 4,993,325 | 2/1991 | Sloane, Jr. et al. | 102/402 |
| 5,001,485 | 3/1991 | Jones | 102/402 |

FOREIGN PATENT DOCUMENTS

| | | | |
|---|---|---|---|
| 0308698 | 3/1989 | European Pat. Off. . | |
| 2403208 | 4/1979 | France . | |
| 2609939 | 7/1988 | France . | |
| 974576 | 2/1961 | Germany . | |
| 977883 | 2/1972 | Germany . | |
| 978056 | 10/1977 | Germany . | |
| 8712313 | 4/1988 | Germany . | |
| 3909160 | 9/1990 | Germany . | |
| 288132 | 3/1991 | Germany . | |
| 116481 | 5/1946 | Switzerland | 102/402 |

OTHER PUBLICATIONS

Volume 1979, pp. 221/222 of "Internationale Wehrrevue", Feb. 1979.

*Primary Examiner*—Ed L. Swinehart
*Attorney, Agent, or Firm*—Wood, Herron & Evans, L.L.P.

[57] ABSTRACT

A vessel in single-hull form is described for sweeping marine mines, which comprises its own remote-controlled motion drive and means for triggering remote-controlled detonators of the marine mines, in particular means including an electromagnet core for producing an electromagnetic field, in which at least one of the two side outlet ends of the electromagnet core extending substantially in the direction of the longitudinal axis of the vessel is downwardly inclined in relation to the verticals.

13 Claims, 3 Drawing Sheets

MARINE MINESWEEPING VESSEL

BACKGROUND OF THE INVENTION

The invention relates to a vessel in single-hull form for sweeping marine mines, which comprises its own, remote-controlled motion drive and means for triggering remote-controlled detonators of the marine mines, in particular means including an electromagnet core for the production of an electromagnetic field.

Vessels of this type have been known and have been in use for a long time. At first towed devices were used for minesweeping, which were provided with means for triggering the detonators of the mines, but subsequently the use of remote-controlled minesweeping boats was adopted, which move in front of a guiding vessel along the areas of water to be swept and are intended to cause the marine mines to explode. In the German navy such a system has been in use under the designation Troika for many years and has been dealt with extensively in literature. Details can be found in German Patent Specification 978 056, the contents of which are herewith made the contents of the present disclosure.

Practice has shown that in fact the coverage, but not however the intensity of the magnetic fields produced by the known remote-controlled vessels have an approximate circular shape, as shown in FIG. 3 of German Patent Specification 978 056. The field intensity has a distinctive dipole characteristic. The amplitudes of the dipole-type field extending in the direction of travel (x), in the horizontal direction transversally thereto (y) and in the verticals (z) are very high and have very steep slopes.

Fields of this type have little in common with the original signatures of large freight ships and warships (so-called target ship signatures), because those original signatures comprise less steep slopes of the field components, non-sinusoidal courses and generally several zero crossings, which in the case of the dipole-type signature of the known minesweeping vessel only applies for the less important field components in the x-direction (direction of travel). The components of those original signatures also have an overall larger spread with an identical absolute height of the amplitudes.

SUMMARY OF THE INVENTION

As mines today have very intelligent sensors and detonator mechanisms, they increasingly better distinguish between signatures of known minesweeping vessels or other vessels and the like less significant for attack, which represent a worthwhile objective. Therefore the object of the invention was to further develop a minesweeping vessel of the type mentioned at the beginning so that in particular the magnetic field produced thereby can be brought closer than before to the original signatures of such ships which are significant for attack by mines, for example to the signatures of larger trading ships or warships.

In the case of a vessel of the type mentioned at the beginning, this object is achieved in that at least one of the two side outlet ends of the electromagnet core extending substantially in the direction of the longitudinal axis of the vessel is downwardly inclined with respect to the verticals.

In this case it is preferred that the electromagnet core is formed by the shell of the vessel. The means for producing the magnetic field are advantageously per se known electromagnet coils which are located in a depression in the shell of the vessel. This depression is closed by a non-magnetic cover in alignment with the shell. It is preferred that the outlet ends of the electromagnet core are constructed as pole shoes, in particular by a shape promoting the directed emergence of the field lines. Thus these pole shoes may have the shape of hemispheres which are disposed inclined into the water. Alternatively it may be provided for that the longitudinal axis of the electromagnet core be inclined by a predetermined angle with respect to the horizontally lying longitudinal axis of the vessel and that both longitudinal axes lie in a common vertical plane. A less space-consuming variant which promotes the objective strived for lies in that the electromagnet core has a V-shaped notch in its lateral elevation so that the longitudinal axes of the arms of the V-shaped electromagnet core extend downwardly inclined with respect to the horizontally extending longitudinal axis of the vessel and that all longitudinal axes lie in a common vertical plane.

It is preferred that the electromagnet core substantially has the shape of a half-cylinder and its diagonally extending side outlet ends are produced by a cut through the half-cylinder, the respective mid-perpendicular of which points sloping downwards in the direction of travel of the vessel and lies in a common vertical plane with the longitudinal axis of the vessel.

Further advantageous refinements and options are given in the sub-claims.

As has been shown, the above-mentioned original signatures of determined large ships are more clearly imitated by the measures specified by the invention than was previously possible, with the consequence that one can expect greater minesweeping success than before, even in cases of mine obstructions which were laid by using particularly intelligent mines.

Furthermore a contribution is made in accordance with the invention towards increasing the minesweeping success if the vessel is equipped with a functional unit which consists of anodes disposed on the shell of the vessel in the water region, an active protective anode also disposed on the shell of the vessel in the water region and a controllable generator for applying a voltage at the anodes and/or if a functional unit is provided which consists of the transmission part with associated antenna and power supply of at least one sonar instrument for emitting higher frequency sound into the water and/or with the use of a functional unit which comprises a coil disposed on the deck of the vessel for producing an electric field.

The invention is explained in further detail below by reference to a drawing.

DETAIL DESCRIPTION OF THE PREFERRED EMBODIMENTS

Figure 1:
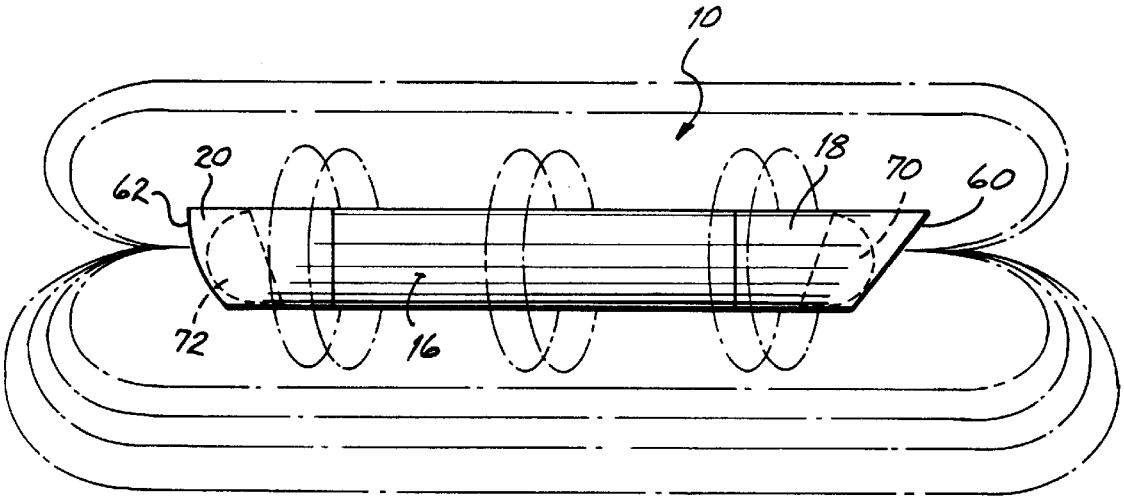
FIG. 1 shows in a diagrammatical representation the hull of a marine minesweeping vessel, the shell of which is constructed as an electromagnet core.
Figure 2:
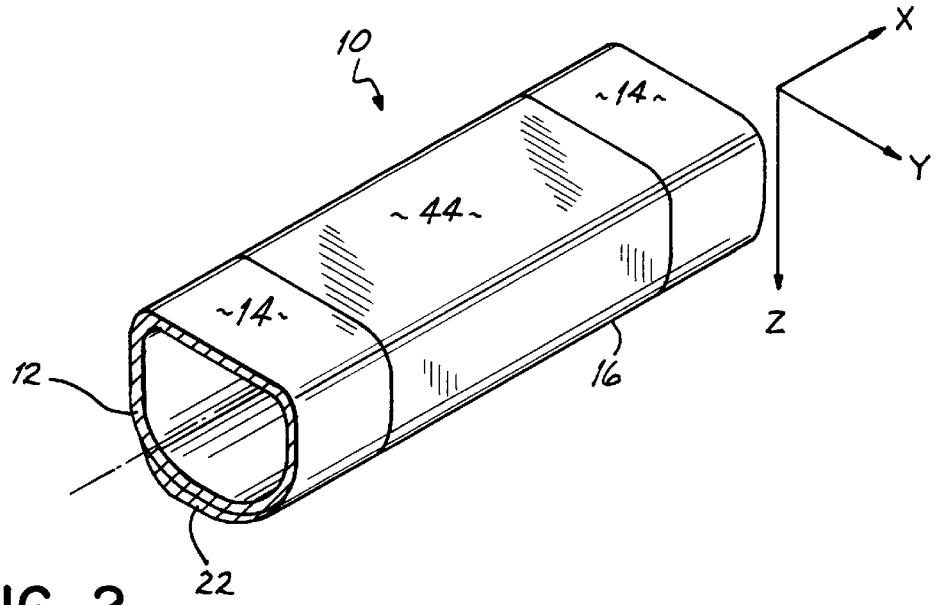
FIG. 2 shows a cross section through the hull.
Figure 4:
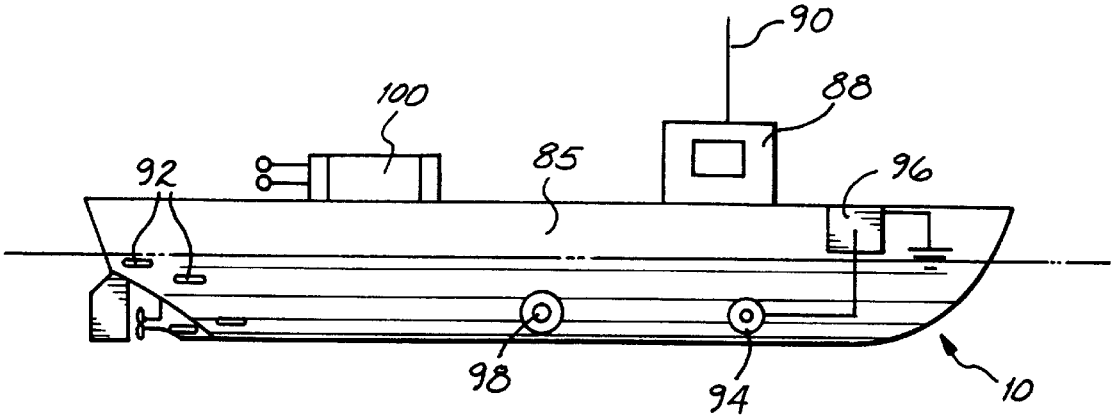
FIG. 4 shows a diagrammatical side elevation of a marine minesweeping vessel according to the invention.

The marine minesweeping vessel represented by way of example and diagrammatically in FIG. 4 has a hull 10, which in all exemplified embodiments has the cross section evident from FIG. 2. As FIG. 2 shows, the hull 10 has the form of a half-cylinder 12, which is closed in the region of its largest diameter by means of a plate 14. The half-cylinder 12 forms the shell of the marine minesweeping vessel and together with the plate 14 and the plates or pole shoes described in further detail below and tightly closing the half-cylinder at the front and rear forms a rigid and highly shock-resistant pressure hull 16, which in addition may in itself be reinforced by transverse bulkheads (not represented) and to which, as is evident from FIG. 1, a forepart 18 and also a rear part 20 are welded to produce a boat shape. As shown in FIG. 2, the pressure hull 16 may be provided on its (lower) side opposite the plate 14 with a material reinforcement 22, which increases the strength and improves the stability of the minesweeping vessel. The pressure hull 16, fore part 18 and rear part 20 and also any frames and transverse bulkheads of the pressure hull are made from ferritic shipbuilding steel (mild steel) in the exemplified embodiment.

Figure 3:
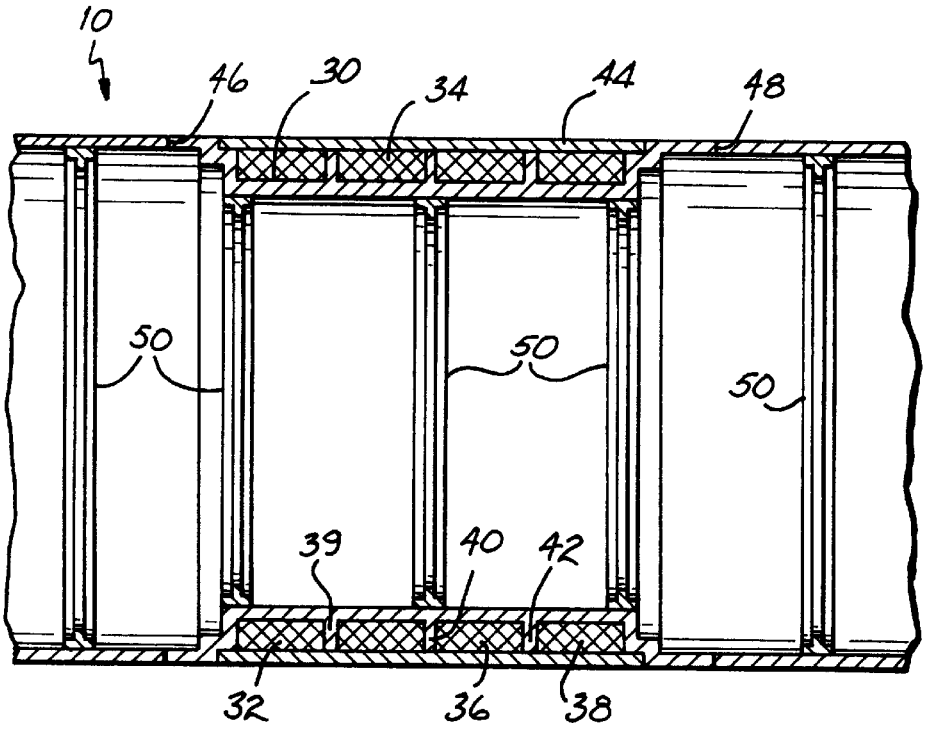
FIG. 3 shows on an enlarged scale a partial longitudinal section through the hull.

At points spaced in the longitudinal direction of the hull 10, as shown in FIG. 3 said hull is provided with depressions 30, in which several electromagnet coils 32, 34, 36, 38 are disposed. According to the representation in FIG. 3, the individual magnet coils are housed in individual chambers, which are formed by the two outer side walls of the depression 30 and also by webs 39, 40, 42 parallel thereto. The radial outer sides of the magnet coils are closed by means of a non-magnetic cover 44, which lies in the plane of the shell of the hull 10.

In the exemplified embodiment shown in FIG. 3 the region of the hull 10 comprising the depression 30 is a separately produced part, which is welded to the hull 10 by means of weld seams 46, 48. Furthermore in FIG. 3 it can be clearly seen that the pressure hull 16 is braced in the region of the depression 30, but also outside it by means of a plurality of frames 50.

The shell of the hull 10 consisting of the many mentioned components is used in accordance with the invention as an electromagnet core for the different magnet coils 32–38 in order in this manner to imitate a magnetic target ship signature as closely to the original as possible as has become necessary for a successful mine defence. An essential component of the invention for the optimal imitation of the target ship signatures is the fact that at least one, but as far as possible both side outlet ends 60, 62 of the electromagnet core described is or are downwardly inclined in relation to the verticals. The terms "down, "up," "front" and "rear", which are occasionally used in this description relate to the vessel described and claimed.

In FIG. 1 it is very diagrammatically illustrated that the drawn, inclined arrangement of the outlet ends 60, 62 results in a strengthening of the magnetic field beneath the hull 10 and in a weakening above the hull. However in practice the use of the shell of the vessel as an electromagnet core in conjunction with the inclined arrangement of the outlet ends results not only in a strengthening of the magnetic field in the water, but also in a field behaviour similar to the target ship in the field directions indicated in FIG. 2: x (longitudinal axis), y (horizontal transverse axis) and x (vertical). Furthermore the target is optimised by the production of alternating magnetic alternating fields, as can be achieved by corresponding power supply of the magnetic coils 32–38 with the use of currents having different curve course, polarity and pulse length.

Figure 7:
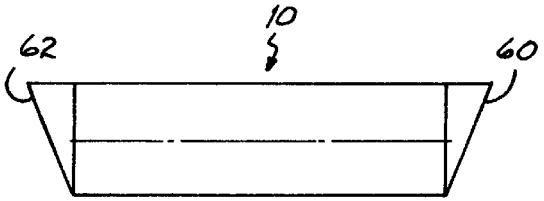
FIG. 7 shows a diagrammatical side elevation of a further embodiment of the hull.
Figure 8:
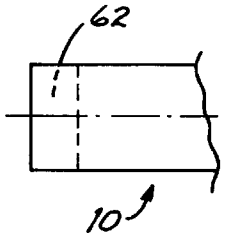
FIG. 8 shows a broken-off plan view of the hull shown in FIG. 7.
Figure 5:
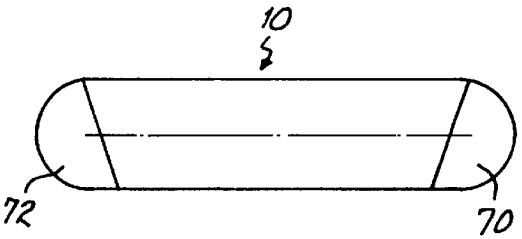
FIG. 5 shows a diagrammatical side elevation of a further embodiment of the hull.
Figure 6:
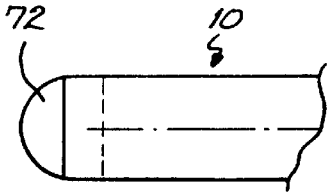
FIG. 6 shows a broken-off plan view of the hull shown in FIG. 5.

Instead of the plate-shaped outlet ends of the electromagnet core, i.e. plane in two directions, illustrated in FIG. 1 and diagrammatically repeated in FIGS. 7 and 8, the electromagnet core may also be sealed by specially formed pole shoes. Thus in FIG. 1 the use of hemispherical pole shoes 70, 72 is indicated by dotted lines and is clarified in FIGS. 5 and 6 by the diagrammatical representation. It is obvious that when the pole shoes 70, 72 shown in FIG. 1 are used, the outlet ends 60, 62 shown there are omitted, with the result that the hull 10 then has at least at its one end the hemispherical shape shown in FIGS. 5 and 6. A fundamental strengthening of the electromagnetic field inside the water also occurs as a result, but its distribution is different when compared with the plate-shaped outlet ends 60, 62.

It will be appreciated that the longitudinal axis of the electromagnetic core may be inclined by a predetermined angle in relation to the horizontally lying longitudinal axis of the vessel and that both longitudinal axes can lie in a common vertical plane. The electromagnet core may also have a V-shaped notch in its side elevation so that the longitudinal axes of the arms of the V-shaped electromagnetic core extend downwardly inclined in relation to the horizontally extending longitudinal axis of the vessel and so that all longitudinal axes lie in a common vertical plane.

Figure 9:
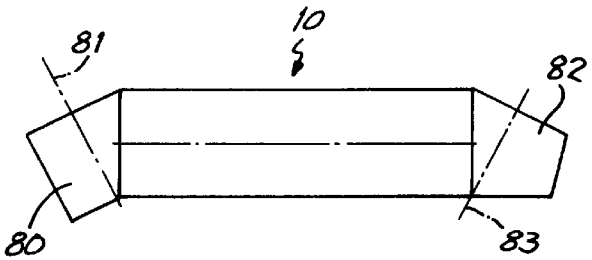
FIG. 9 shows a diagrammatical side elevation of a further embodiment of the hull.
Figure 10:
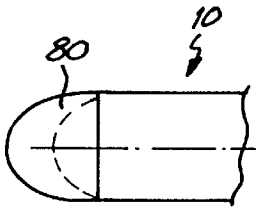
FIG. 10 shows a broken-off plan view of the hull shown in FIG. 9.

FIG. 9 shows two variants of pole shoes to which further modifications have been made. One of the shown advantageous possible designs of a pole shoe is attached to the hull 10 on the left as shown in FIG. 9. This pole shoe 80 is basically a half-cylinder with a cylinder axis 81, from which the plan view shown in FIG. 10 is produced. As can be seen in FIG. 9, the half-cylinder of pole shoe 80 is extended in the upper region beyond the cylinder axis 81 so that it can be connected to the substantially semi-cylindrical pressure hull 16 and protrudes slightly downwards beyond the under side of the hull.

The right-hand end of the hull 10 in FIG. 9 very largely corresponds to the left end; however the pole shoe 82 there, the cylinder axis 83 of which corresponds to that of the left pole shoe 80, is flattened on its underside so that on its underside pole shoe 82 forms a rectilinear continuation of the underside of the hull, while its semi-cylindrical end face corresponds to that of pole shoe 80.

As can be seen from FIG. 4, on the hull 10 of the minesweeping vessel is located a superstructure 85, which is preferably manufactured from non-magnetic steel or another non-magnetisable material. The superstructure comprises a deckhouse 88, which in turn bears an antenna 90, which is required for the remote control of the vessel.

To imitate electric fields or the electric potential between vessel, sea water and the conventional corrosion protection anodes of target ships, zinc anodes 92 and also an active protective anode 94 made from precious metal, with which a controllable generator 96 beneath the deck of the vessel is associated, are mounted on the shell of the hull 10 inside the water. Anodes, generator, control unit for this and also the associated cables represent a functional unit.

A further functional unit is provided for the selective imitation of hydroacoustic fields, in particular corresponding to the active sonar range of conventional mine-hunting vessels. This functional unit comprises a sound transmitter with an associated antenna and current supply, which preferably transmits the higher frequency sound of mine-hunting vessels into the water. In FIG. 4 this functional unit is symbolised by a transmitting hydrophone 98 in the region of the hull 10.

Finally the vessel according to the invention shown in FIG. 4 comprises an air-core coil 100 as a further functional unit on deck and also further structural components under the deck of the vessel, in particular a sine wave generator with a following power amplifier which is connected to the air-core coil 100 in order to imitate the magnetic stray field of alternating current consumers on board target ships.

In conclusion it should be stressed that the representation of the ship in FIG. 4, in so far as it differs from the representations of the hull in the remaining figures, is only to be regarded as an example and is not intended to indicate that a hull according to the invention should be constructed differently from the representations in FIG. 1 to 3 and 5 to 10.

We claim:

1. A vessel for sweeping marine mines comprising:

a single-hull body having a shell and a length extending along a longitudinal axis of the body, a motion drive connected with the hull and including a control operable from outside the vessel for directing the operation of the motion drive, an electromagnet core for triggering remote detonators of the marine mines through the production of an electromagnetic field, said electromagnet core extending substantially along the length and in the direction of the longitudinal axis of the body and including a pair of opposite ends, wherein at least one of the ends is inclined downward with respect to the longitudinal axis.

2. A vessel according to claim 1, wherein the electromagnet core is formed by the shell of the vessel.

3. A vessel according to claim 1, wherein the electromagnet core includes electromagnet coils located in depressions in the shell of the vessel and the depressions are sealed with a non-magnetic cover in alignment with the shell.

4. A vessel according to claim 1, wherein the ends of the electromagnet core are constructed as pole shoes.

5. A vessel according to claim 4, wherein the pole shoes are constructed as hemispheres inclined downward with respect to the longitudinal axis.

6. A vessel according to claim 4, wherein at least one of the pole shoes has the shape of a half-cylinder having an inclined center axis and including one of the ends of the electromagnet core, the center axis being inclined so that the intensity of the magnetic field emerging downwardly from the half-cylinder is greater than the intensity of the magnetic field which emerges upwardly.

7. A vessel at least according to claim 1, wherein the longitudinal axis of the electromagnet core is inclined by a predetermined angle in relation to the longitudinal axis of the body of the vessel, and both longitudinal axes lie in a common vertical plane.

8. A vessel according to claim 1, wherein the electromagnet core has substantially the shape of a half-cylinder and the ends are produced by a portion of the half-cylinder.

9. A vessel according to claim 1, wherein the shell of the vessel includes a keel region and is provided with a material reinforcement in the keel region.

10. A vessel according to claim 1 further comprising anodes disposed on the shell of the vessel including an active protective anode and further including a controllable generator for applying a voltage to the anodes.

11. A vessel according to claim 1 further comprising a transmitting device operatively connected with an antenna and a power supply and to at least one sonar instrument for emitting high frequency sound waves into the water.

12. A vessel according to claim 1 further comprising an air-core coil disposed on an upper deck of the vessel for producing an electrical field.

13. A vessel according to claim 1, wherein both ends are inclined downward with respect to the longitudinal axis of the body.

* * * * *